US010471332B2

(12) United States Patent
Scheingraber

(10) Patent No.: US 10,471,332 B2
(45) Date of Patent: Nov. 12, 2019

(54) SKI BINDING RESCUE DEVICE

(71) Applicant: Joan Scheingraber, Hailey, ID (US)

(72) Inventor: Joan Scheingraber, Hailey, ID (US)

( * ) Notice: Subject to any disclaimer, the term of this patent is extended or adjusted under 35 U.S.C. 154(b) by 163 days.

(21) Appl. No.: 15/874,809

(22) Filed: Jan. 18, 2018

(65) Prior Publication Data

US 2018/0200607 A1 Jul. 19, 2018

Related U.S. Application Data

(60) Provisional application No. 62/447,765, filed on Jan. 18, 2017.

(51) Int. Cl.

| | |
|---|---|
| ***A63C 11/00*** | (2006.01) |
| ***A63C 5/16*** | (2006.01) |
| ***A63C 5/00*** | (2006.01) |
| ***A63C 5/03*** | (2006.01) |
| ***A63C 9/00*** | (2012.01) |

(52) U.S. Cl.

CPC ..... *A63C 5/033* (2013.01); *A63C 9/002* (2013.01); *A63C 11/002* (2013.01)

(58) Field of Classification Search

CPC ... A63C 11/001; A63C 11/002; A63C 11/023; A63C 11/025; A63C 11/021; A63C 11/02; A63C 5/02; A63C 5/031; A63C 5/052; A63C 5/065; A63C 5/16

See application file for complete search history.

(56) References Cited

U.S. PATENT DOCUMENTS

| | | | | | |
|---|---|---|---|---|---|
| 2,122,347 | A * | 6/1938 | Lasch | A47C 1/14 | 280/812 |
| 2,203,909 | A * | 6/1940 | Insam | A63C 11/002 | 280/14.1 |
| 2,357,928 | A * | 9/1944 | Bowen | B62B 13/06 | 280/22 |
| 2,589,764 | A * | 3/1952 | Basso | B62B 13/06 | 280/22.1 |
| 3,081,107 | A * | 3/1963 | Cantelli | B62B 13/06 | 188/8 |
| 3,275,160 | A * | 9/1966 | Zurker | A63C 11/006 | 211/4 |
| 3,858,897 | A * | 1/1975 | Bradford | B62B 13/06 | 280/17 |
| 3,862,764 | A * | 1/1975 | Hartz | A63C 5/16 | 280/818 |
| 3,907,320 | A * | 9/1975 | Charneck | A63C 5/06 | 280/818 |
| 3,953,042 | A * | 4/1976 | Pyzel | A63C 9/08 | 280/614 |

(Continued)

*Primary Examiner* — James A Shriver, II
*Assistant Examiner* — Vaughn Coolman
(74) *Attorney, Agent, or Firm* — Shaver & Swanson, LLP; Scott D. Swanson

(57) ABSTRACT

A ski binding rescue device having an attachment mechanism for attaching the device to a pair of skis to form a sled. The device attaches to the bindings of a pair of skis and serves to maintain the skis in a parallel orientation. The device has an attachment mechanism for attaching to the toe portion of a ski binding and to the heel portion of a ski binding. The device has one or more rigid lengths that span between the ski binding attachments to serve to connect and maintain the skis in a parallel orientation and potentially to provide an area to place a person to be moved on the sled or other goods.

13 Claims, 8 Drawing Sheets

(56) References Cited

U.S. PATENT DOCUMENTS 4,049,291 A * 9/1977 Nunan ..... A63C 9/0807 280/614
4,211,433 A * 7/1980 Pedersen ..... A63C 5/03 280/601
4,261,595 A * 4/1981 Smialowski ..... A63C 9/0842 280/614
4,275,904 A * 6/1981 Pedersen ..... A63C 5/16 280/14.1
4,324,409 A * 4/1982 Larsen ..... A63C 11/002 280/14.1
4,334,691 A * 6/1982 Scheib ..... A63C 5/16 280/14.1
4,627,636 A * 12/1986 Payraud ..... A63C 5/16 280/607
4,643,444 A * 2/1987 Parkinson ..... A63C 5/16 280/606
4,744,584 A * 5/1988 Monreal ..... A63C 9/00 280/606
4,762,339 A * 8/1988 Hoek ..... A47C 1/14 280/812
5,509,665 A * 4/1996 Hansen ..... B62B 13/06 280/21.1
5,551,728 A * 9/1996 Barthel ..... A63C 5/02 280/14.1
D390,500 S * 2/1998 Walker ..... D12/6
5,791,610 A * 8/1998 Sanchez ..... F41B 5/14 224/916
6,142,313 A * 11/2000 Young ..... F41A 17/02 211/4
6,969,074 B2 * 11/2005 Piper ..... A63C 5/06 280/14.1
8,342,575 B2 * 1/2013 Coleman ..... A63C 5/16 24/298
8,529,268 B2 * 9/2013 Coleman ..... A63B 69/18 434/253
8,534,697 B2 * 9/2013 Lengel ..... A63C 9/06 280/617
9,192,846 B2 * 11/2015 Ruiz ..... A63C 5/16
9,573,044 B2 * 2/2017 Yi ..... A63C 5/02
9,724,590 B2 * 8/2017 Reinig ..... A63C 5/031
9,731,187 B2 * 8/2017 Hurth ..... A63C 5/16
2005/0001391 A1 * 1/2005 Piper ..... A63C 5/06 280/14.1
2013/0009387 A1 * 1/2013 Maruelli ..... A63C 9/02 280/611
2013/0168952 A1 * 7/2013 Starry ..... A63C 11/025 280/814
2013/0316317 A1 * 11/2013 Bilbao ..... A63B 21/4015 434/253
2016/0089591 A1 * 3/2016 Williamson ..... A63B 69/0093 434/253

* cited by examiner

SKI BINDING RESCUE DEVICE

PRIORITY/CROSS-REFERENCE TO RELATED APPLICATIONS

This application claims the benefit of U.S. Provisional Application No. 62/447,765 filed Jan. 18, 2017, the disclosure of which is incorporated by reference.

TECHNICAL FIELD

The presently disclosed technology generally relates to the field of snow skiing, and more particular embodiments relate to an apparatus which may be used to form an evacuation sled or cargo carrier by combining a pair of skis.

BACKGROUND

Snow skiing (hereinafter "skiing") is a popular recreational activity boasting millions of participants each year. There are different types of skiing to suit a variety of tastes and interests. Regardless of the type of skiing involved, skiing generally requires a pair of skis, ski bindings, and ski boots. Ski bindings are devices that are affixed to the skis by engaging rigid formations on the exterior of the ski boot at the toe and heel. Ski bindings may be a single piece, or may have a separate toe and heel piece, depending on the application. While the purpose of the bindings is to secure the boot to the ski, bindings are also designed to release the boot when certain forces are applied, such as when a skier falls, thereby prevent injury. The amount of lateral force needed to release a ski boot from the binding can be controlled by adjusting a binding's release setting, commonly called a DIN setting in alpine bindings.

In addition to accommodating different DIN settings, ski bindings themselves are specialized depending on the type of skiing at issue. Alpine skiing, also called downhill skiing, involves an often fast-paced descent down a ski run and usually takes place in a ski resort. An alpine ski binding is typically designed to retain the ski boot at both the toe and heel with minimal movement once engaged. This allows a user to efficiently "steer" while descending by shifting the user's weight. Cross-country skiing, or Nordic skiing, involves a slower traverse over rolling or flat land through the backcountry, often away from ski resorts or other facilities. Because cross-country skiing requires a participant to have greater movement in their heel as they glide across the land, cross-country bindings affix the toe of a ski boot to the ski, but allow the boot's heel to be lifted from the ski. Still another type of binding known as alpine-touring, or AT binding, allows the heel of the boot to be lifted while traversing snow covered ground, and then locked into place for a downhill descent. Some of these AT bindings have a separate toe and heel piece. Like other bindings, AT bindings generally employ a clamping mechanism to hold the toe and heel of the boot, including the use of pins to lock into recesses located on the toe and heel of a specialized AT boot.

Regardless of the type of skiing enjoyed and the safety measures used, there remains an inherent risk that a skier may become injured (ex: broken leg, etc.), potentially leaving him/her with limited mobility until he/she can receive medical treatment. If an accident occurs at a ski resort, the resort typically uses snowmobiles or other emergency response resources to assist the skier off of the mountain as quickly and efficiently as possible. While getting off of the snow and into a medical facility in these situations is inherently challenging, doing so is particularly difficult for backcountry skiers as they are often off-trail, far from traditional ski facilities and away from the relatively easy reach of snowmobiles, etc. Fellow skiers may be faced with the difficult task of trying to transport an immobile skier through the snow to medical help a significant distance away. As time is of the essence in an emergency setting, having a quick egress is essential for survival not only from the injury itself, but from exposure to the elements. Thus, a need exists to ease the transport of an injured or otherwise immobile skier or for a skier to evacuate his or her self. At the same time, skiers, especially backcountry skiers, need to travel light and carry only the essential gear. The present device addresses this problem by using a lightweight, strong apparatus to combine a pair of skis to form an evacuation sled capable of being pulled and/or steered by another person or machine or by one's self. Further, this device may be used to create a sled from skis which may carry additional gear or cargo into and out of the backcountry.

SUMMARY OF THE DISCLOSURE

The purpose of the summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the inventive concept(s) of the application, which is measured by the claims, nor is it intended to be limiting as to the scope of the inventive concept(s) in any way.

The disclosed device has a pair of elongated members with attached mounts designed to engage the mechanisms at the toe and heel of bindings on a pair of skis or to hold the skiis together without engaging the mechanism, typically belonging to the injured skier who is unable to use his/her skis due to injury. When each member is rigidly connected at either end to the corresponding ski binding, the toe and heel member connect the skis to form a sled-like apparatus capable of supporting an injured skier and his/her gear to allow fellow skiers to more easily transport the injured skier to the nearest medical assistance. In addition, the sled-like feature allows backcountry skiers to bring in other gear or items as they enter or exit the backcountry.

The device includes a toe member with attached toe mounts, used to engage the toe clamp of the bindings, and a heel member used to attach to the heel end of the bindings. The toe member and heel member are preferentially constructed of a lightweight, strong material, such as aluminum, titanium, or high-strength plastic, though other suitable materials will be known to those skilled in the art. While the toe member and heel member can be either a fixed length or an adjustable length so as to be a sufficient length to span across a pair of skis when the skis are laid side by side in their usual orientation. These lengths can be separated such that the device is composed of two more units, as illustrated in the drawings, or the device can be unitary or connectable to form a single device in alternate embodiments. In an embodiment in which the toe member and heel member are extendable, the toe member and heel member include a locking mechanism to allow a user to lock the expandable members at a particular length.

As mentioned, the toe member and heel member use toe mounts and heel mounts, respectively, to attach to the corresponding toe and heel portions of the bindings. In a preferred embodiment, the toe member includes a toe mount on either end of the member. The mounts may be designed to be attachable to, and removable from, the toe member.

Alternatively, the toe mounts may be integrated into the toe member such that the toe member with toe mounts is a single piece.

Similarly, the device includes heel mounts capable of being attached to, or mounted on or integrated with, as in the case of a mechanism that simulates the attachment of a ski boot to the binding, the heel member. The heel mounts will typically be located at opposing ends of the heel member and be configured to engage or integrate into the heel mechanism of the ski binding.

Whether integrated with, or removable from, their respective members, the toe mounts and heel mounts in a preferred embodiment are designed to generally simulate the shape of the toe and heel, respectively, of a ski boot compatible with the ski bindings. Thus, in a ski binding, such as an alpine binding, designed to clamp the toe of a ski boot containing a rigid flange of a particular width and thickness, the toe mount would incorporate a flange of similar dimensions. If a pin-tech style AT binding is being used, the toe clamp of which is designed to engage recesses on either side of a compatible pin-tech AT ski boot, the toe mount would incorporate toe mount recesses in the same location so as to allow the pin-tech toe clamp to securely retain the toe mount. While it is within the scope of the invention that a particular toe mount or heel mount may be configured to work with a particular binding type or brand, it is also within the scope of this disclosure that a universal toe mount or heel mount could be designed. A telemark boot design, an alternative alpine touring binding design, cross country binding design a typical downhill ski binding design, or any other type of ski binding design are also included in the spirit of the invention disclosed herein. For example, a universal toe mount may incorporate both the rigid flange and the toe mount recesses compatible with pin-tech bindings.

In addition to configuring the toe and heel mounts as described, additional measures may be taken to ensure that the toe and/or heel members are secured to the bindings during use. For example, while the toe clamp of a pin-tech binding typically engages and squeezes the recesses of the boot toe from opposing sides, in a pin-tech heel binding, the pins may extend from the body of the heel binding in a direction roughly parallel to the skis. This design effectively secures an AT boot that is simultaneously locked into the toe binding, thereby providing the force required to remain engaged with the heel pins during normal use. This may not be as effective, however, at retaining the disclosed heel member which, unlike the boot, is not engaged with the toe end of the binding. To address this problem, a preferred embodiment of the heel member includes one or more openings for attaching restraining straps or ropes or cords to secure itself to the body of the heel portion of the binding. A restraining strap, or rope or cord is utilized to wrap around the body of the heel portion of the binding, or around heel portions of both bindings, to secure the mechanism to the skis. While one or more straps are used as a lightweight method of securing the heel portion, having a heel portion that does not require straps is within the scope of this invention.

For example, in an embodiment compatible with a pin tech binding, the heel mounts are integrated into the heel member and include recesses capable of accommodating the pins extending from the heel portion of the binding. In a preferred embodiment the device is designed to support the use of straps to further affix the heel portion of the device to the binding. Similarly embodiments can include a strap to further affix the toe portion of the device to the binding. This can be done with one or more straps. In a further embodiment, no straps will be needed to secure the device. The straps are long enough to wrap around the body of the heel portion of the binding and connect on the side opposite the pins, thereby restraining the heel member against the heel pins and securing it to the heel portion of the bindings. In an alternative embodiment, a single restraining strap is affixed to one end of the heel member and is capable of wrapping around the bodies of the heel portion of the bindings as described and attaching to the other end of the heel member.

Depending on the type of bindings or other equipment used, additional manipulation of the bindings may be needed to secure the toe member or heel member. For example, skis typically include a brake, which is a U-shaped device whose base is integrated into the heel portion of the ski binding and spans the width of a ski. The legs of the brake extend from either side of a ski and point in either an upward, or disengaged, position, or in a downward, or engaged, position. The purpose of the brake is to slow or stop a "runaway" ski that has escaped the control of its owner. Thus, when a ski is in use and a ski boot is locked into the heel portion of a binding, the brake is disengaged and is in an upright position, preventing it from interacting with the snow and slowing the skier. When a ski boot is not attached to the ski binding, such as might happen immediately after a fall, the brake is engaged and is pointed downward where it interacts with the snow such that it arrests a "runaway" ski.

It may be desirable that the brake be in a disengaged position when the disclosed device is being used to transport someone across the snow. Depending on the type of binding used, however, it may be necessary to manipulate the binding such that the heel member may be affixed to the binding with the brake in a disengaged state. For example, when securing the heel member to the heel portion of pin-tech bindings, it may be necessary to rotate the body of the heel portion such that the pins face toward the tail of the ski. Pin-tech bindings are designed to have a disengaged brake in this position, which is used when in touring mode. In a preferred embodiment, the heel member may be attached to pin-tech bindings by rotating the heel portion of the bindings as described, wrapping the straps around the heel portion of the bindings, and securely connecting the straps to each other as disclosed. On other bindings, the brake can be locked in the raised ski position. In this case, the heel portion of the binding may not need to be rotated.

In addition the restraining straps, the toe member and heel member may also contain methods of attaching gear, such as ski poles, rope, or packs, for ease of transport. These other attachment methods may be additional holes, slots for putting straps or ropes through, straps, loops, or other securing material made of nylon or some resilient material, collapsible netting, or some other method. This securing material may be attachable to and removable from the toe member and heel member as needed.

Further disclosed is a method of attaching the ski binding rescue device to a pair of skis having ski bindings mounted on the skis. The method includes the step of providing a binding toe connector having a first toe clamp connection member and a second toe clamp connection member. The first binding clamp connection member and said second binding clamp connection member are separated by a first rigid length.

The method includes the step of providing a binding heel connector having a first heel clamp connection member and a second heel clamp connection member. The first binding heel connector member and said second binding clamp connection member are separated by a second rigid length generally equivalent to said first rigid length.

The method includes the step of attaching said binding toe connector to said pair of skis, wherein said step comprises connecting said first toe clamp connection member to said first ski at said ski binding toe clamp and attaching said second toe clamp connection member to said second ski at said ski binding toe clamp.

The method includes the step of attaching said binding heel connector to said pair of skis, wherein said step comprises connecting said first heel clamp connection member to said first ski at said ski binding heel clamp and attaching said second heel clamp connection member to said second ski at said ski binding heel clamp such that said first ski and said second ski are in a generally parallel orientation and maintained in said orientation by said binding toe connector and said binding heel connector. The method then involves the step of attaching a cargo, such as an injured human, to the now formed sled.

It is further noted that while the device is often called a "ski binding rescue device" herein, this term is not limiting as to the use of the device. The device can be used in a plethora of ways such as for a sled for carrying gear or other materials.

DETAILED DESCRIPTION OF THE PREFERRED EMBODIMENTS

Figure 1:
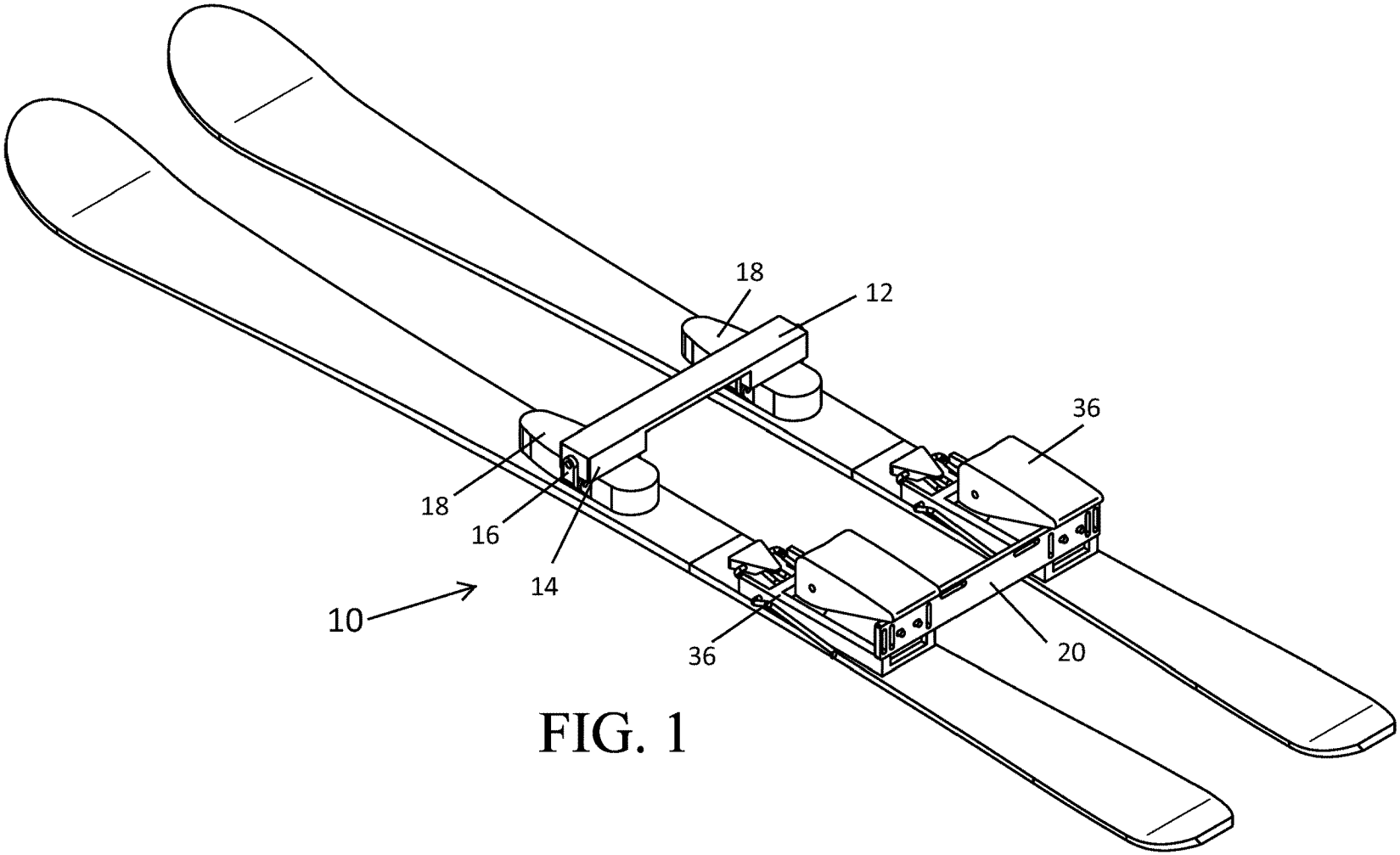
FIG. 1 is a perspective view of a ski binding rescue device depicting the toe member and heel member engaged with a pair of pin-tech ski bindings.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

While in the depicted embodiment the device is depicted as integrating with pin-tech AT style bindings, the inventive concepts disclosed herein is not limited to pin-tech AT style bindings. The inventive concepts can be utilized with traditional alpine bindings or any other style binding, including telemark or frame style bindings. The inventive concepts disclosed herein are not limited to AT style bindings, as clip-in bindings, such as those used for cross country skiing, and NNN bindings, requiring only a toe piece, may be utilized as may future binding devices.

FIG. 1 illustrates an embodiment of the inventive concepts of the ski binding rescue device 10 depicting the toe member 12 and heel member 20 engaged with a pair of pin-tech ski bindings attached to a pair of skis. FIG. 1 depicts the toe member 12 and the heel member 20 attached to the toe clamp and heel clamp, respectively, of the ski bindings 18, 36. Because the depicted bindings are pin-tech AT style, the heel piece of the bindings is rotated such that the pins face the tail of the ski. FIG. 1 shows the heel member 20 engaged with the pins of the heel portions of the heel binding 36.

Figure 2:
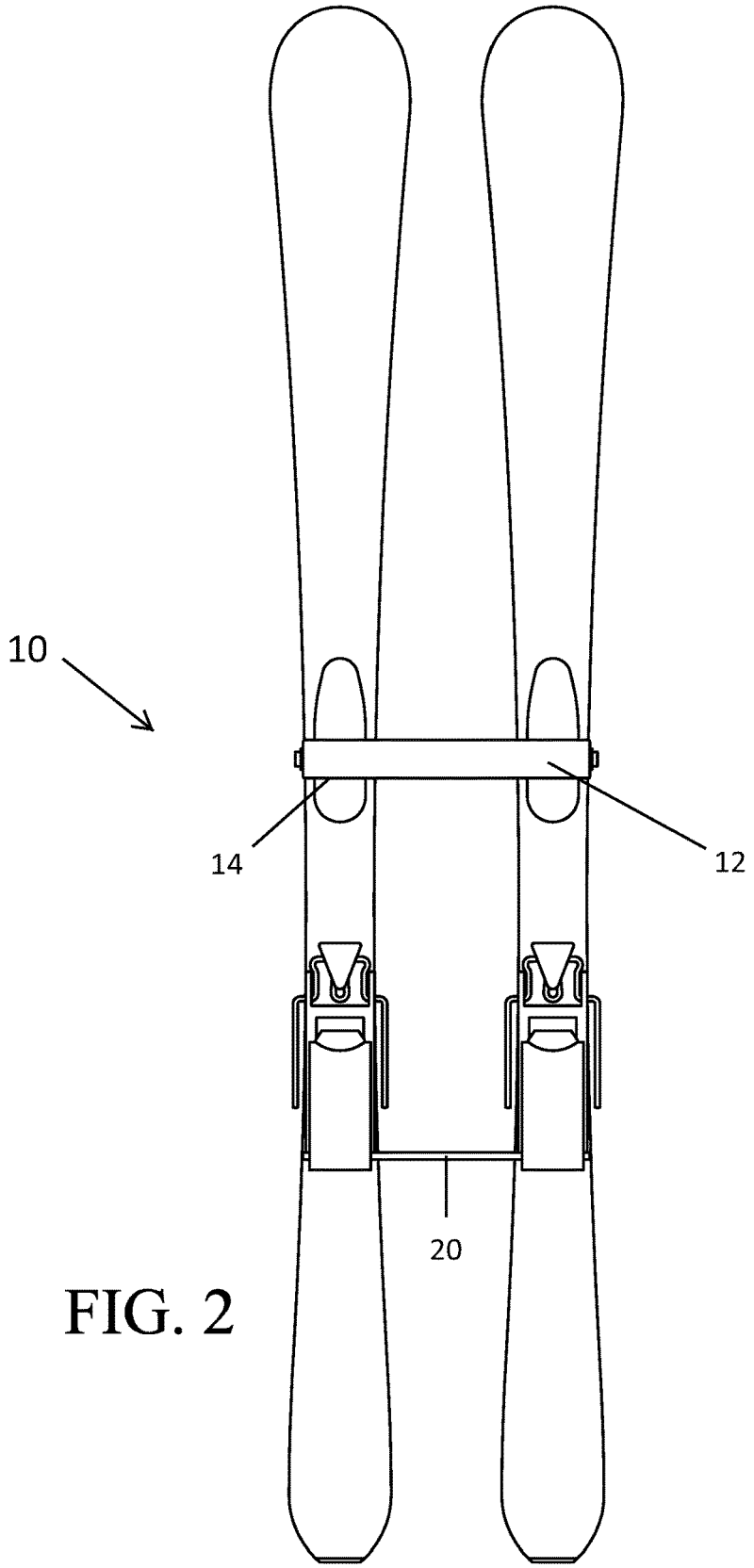
FIG. 2 is a top view of a ski binding rescue device engaged with a pair of ski bindings mounted on a pair of skis.

FIG. 2 is an embodiment of the ski rescue device attached to a pair of skis with mounted bindings. Toe member 12 is attached toe mounts 14 in an engaged state. FIG. 2 depicts the toe member 12 as a solid piece of metal, to which are attached two toe mounts 14. A variety of ski binding toe pieces are available on the market, and further embodiment compatible with this variety of toe pieces are within the scope of the inventive concepts disclosed herein. The toe mounts 14 are configured such that they are capable of being engaged by the toe clamps of the pin-tech ski bindings (Shown in FIGS. 6-7) through the incorporation of toe piece 16 on either side of each toe mount 14. The toe mounts 14 of FIG. 2 are removable from the toe member 12.

Figure 4:
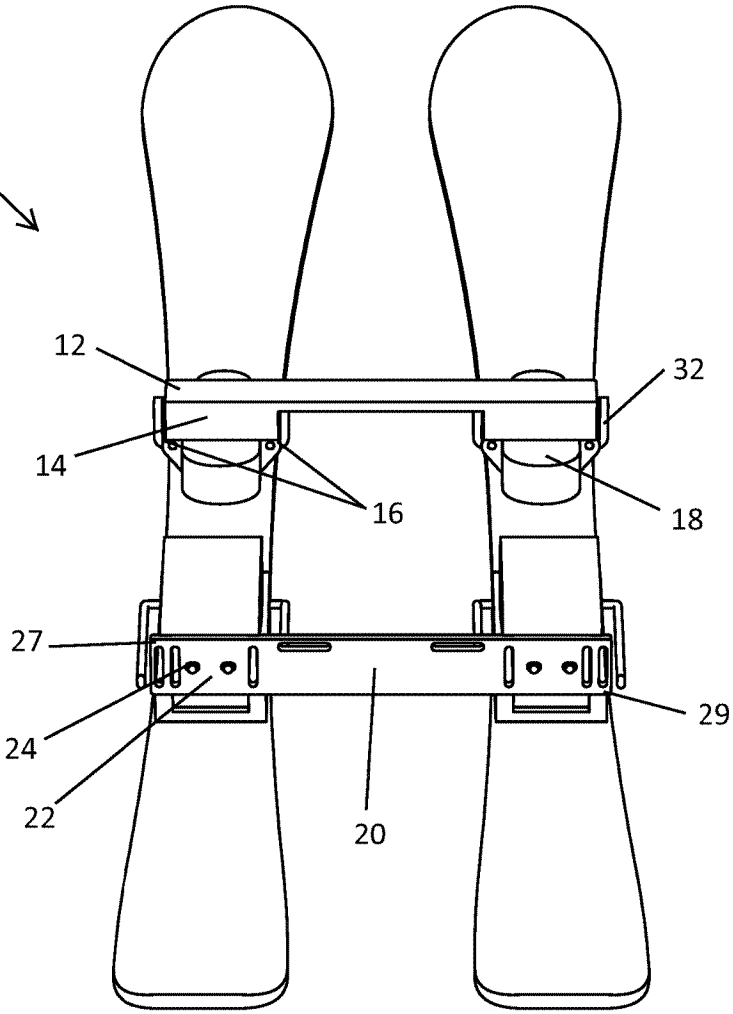
FIG. 4 is a rear perspective view of a heel member with openings configured for insertion of pins on the back of pin-tech ski bindings.
Figure 3:
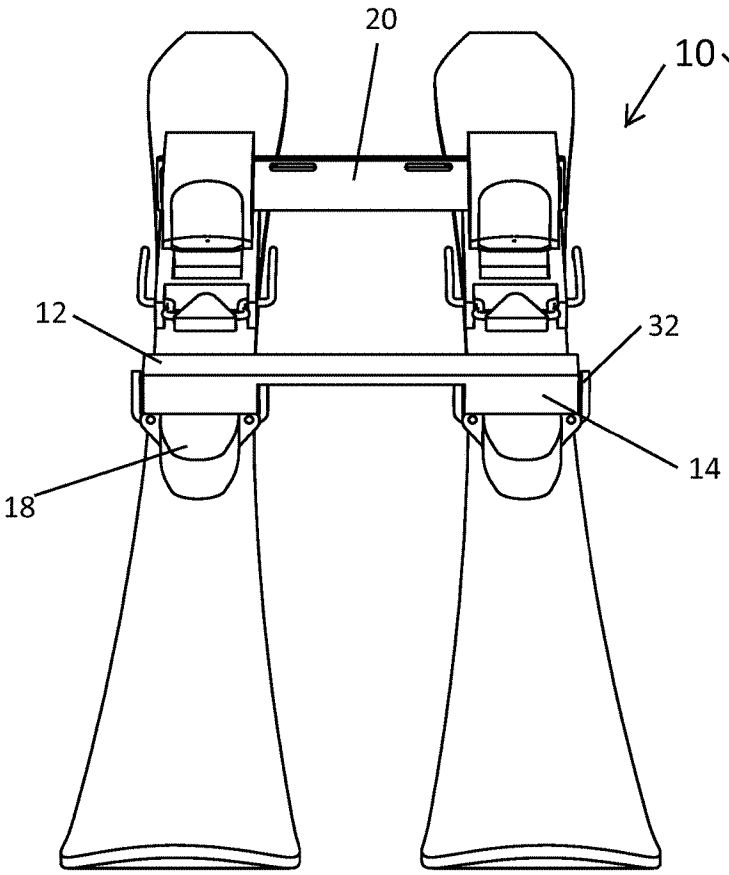
FIG. 3 is a front perspective view of the ski binding rescue device depicting the toe member and heel member engaged with pin-tech ski bindings, with the toe member in the foreground showing the attached toe mounts engaged with the toe portion of pin-tech ski bindings.

FIGS. 3-4 are front and rear perspective views, respectively, of an embodiment of the inventive concepts of the ski binding rescue device 10 depicting the toe member 12 and heel member 20 engaged with pin-tech ski bindings. The toe member 12 in the foreground showing the attached toe mounts 14 engaged with the toe clamps 32 of pin-tech ski bindings 18. The toe clamps 32 of the pin-tech ski bindings 18 are clasping the toe mounts 14 of the toe member 12 by engaging toe mount recesses 16 on either side of each toe mount 14, which mimic the recesses found in the toe of a pin-tech ski boot. Alternatively the pin and recess format can be reversed, with the recess found on the binding and the pin found on the ski rescue device.

Figure 5:
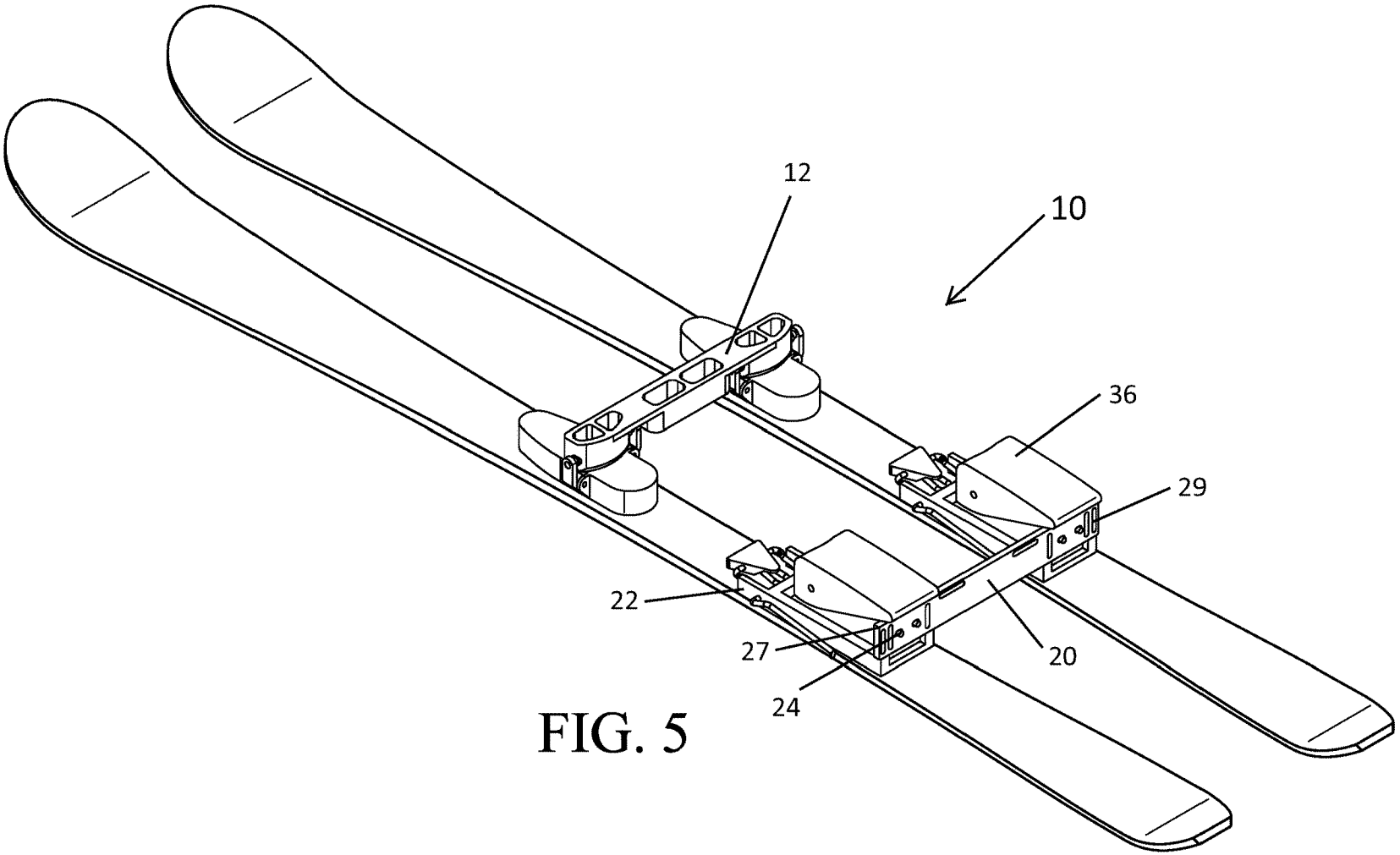
FIG. 5 is a perspective view of the ski binding rescue device depicting the toe member and heel member attached to pin-tech ski bindings, with the heel member in the foreground showing the integrated heel mount recesses engaging the pins.
Figure 9:
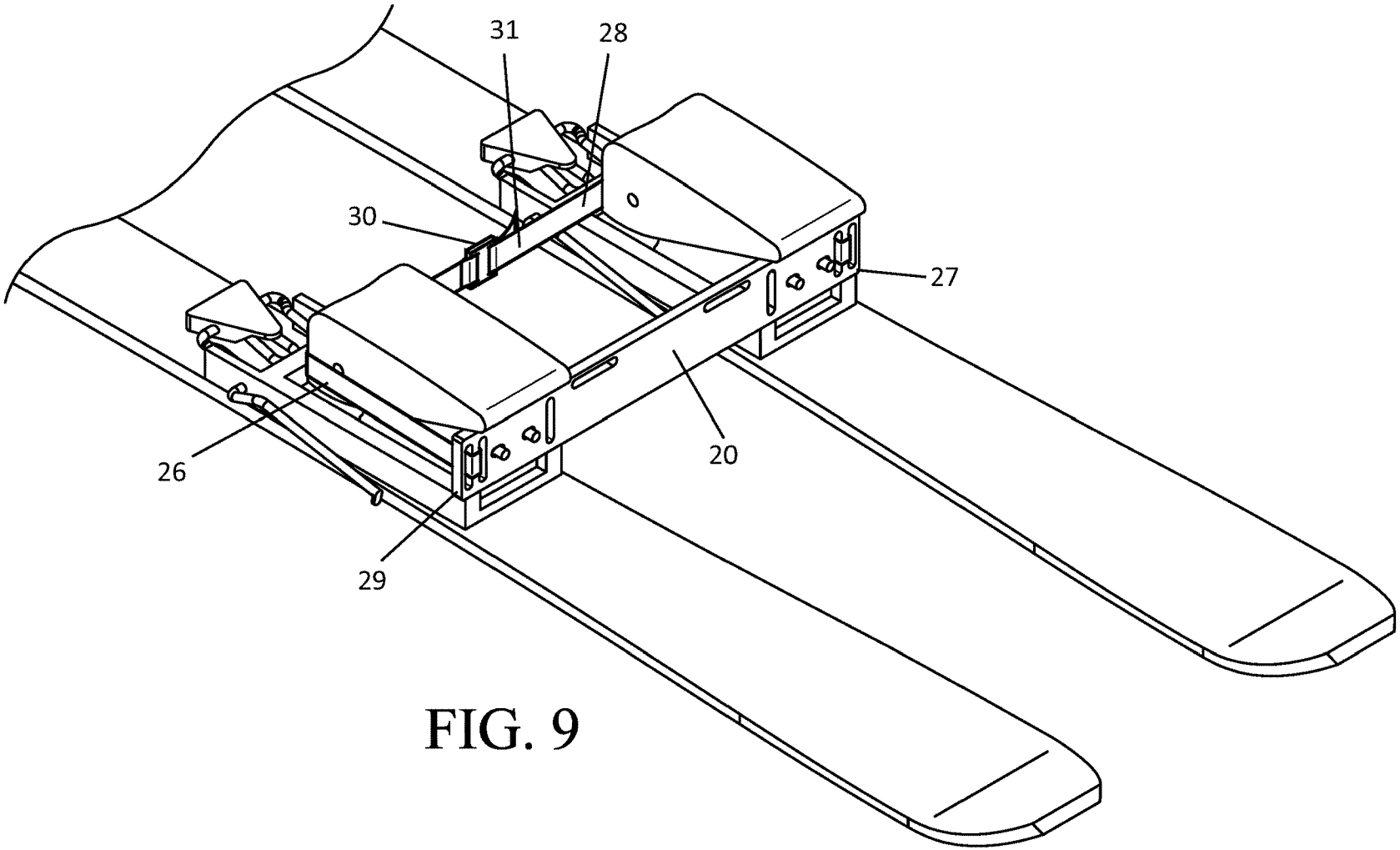
FIG. 9 is a perspective view of an embodiment of a ski binding rescue device attachment mechanism to a rear binding.

FIG. 5 is a perspective view of an embodiment of the invention attached to a pair of skis via mounted ski bindings. Heel connector 20 includes integrated heel mounts 22, heel mount recesses 24. Not shown are restraining straps 26, 28 that are included in a preferred embodiment and depicted in FIGS. 9 and 10. Integrated heel mounts 22, which include heel mount recesses 24 contained within the heel member 20 and positioned such that they are capable of being engaged by the pins of the heel portion of the pin-tech ski bindings. FIG. 9 also depicts the restraining straps 26, 28 affixed to the first heel end 27 and second heel end 29 of the heel member 20. The restraining straps 26, 28 include an adjustable buckle 30 capable of connecting the restraining straps 26, 28 and tightening the connected straps to further secure the heel member 20 to the heel portion of the pin-tech bindings 36.

Figure 6:
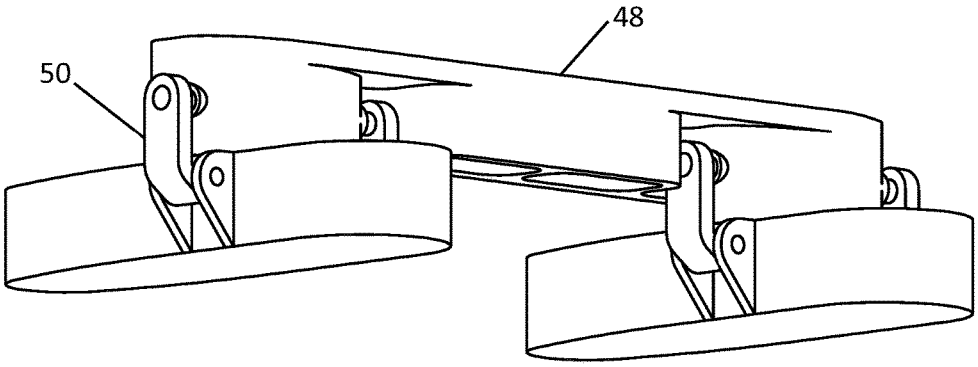
FIG. 6 is a perspective view illustrating a pin-tech style toe binding attached to the toe connector of a ski binding rescue device.
Figure 7:
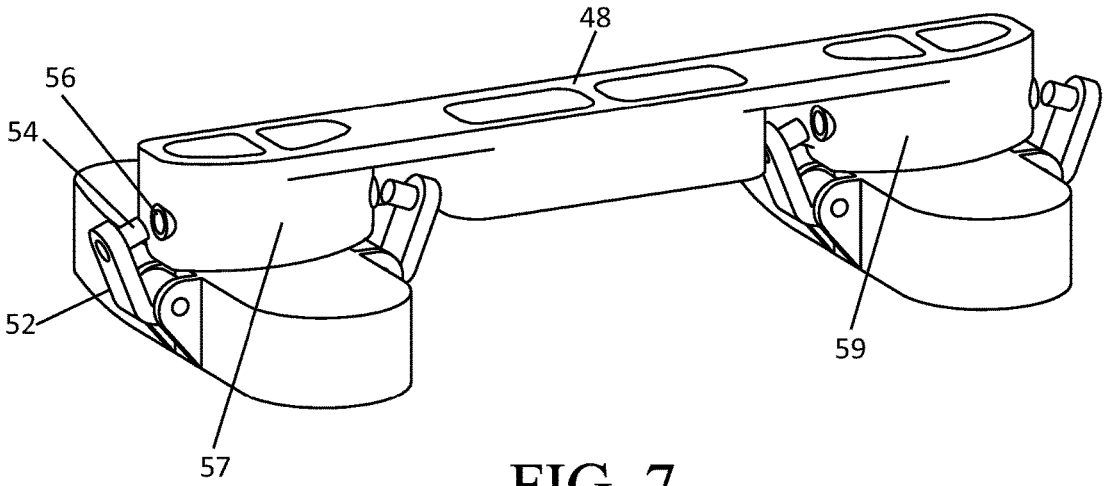
FIG. 7 is a perspective view illustrating a pin-tech style toe binding in an open setting illustrating the mating point between recesses on the ski binding rescue device in relation to the pins of the toe portion of a pin-tech style binding.

FIGS. 6 and 7 depict the attachment mechanism of an embodiment of the invention configured for Tech or pin style toe mounts or clamps. FIG. 6 depicts the clamps in a closed position 50 attached to recesses, in the depicted embodiment an opening, 56 into which pins 54 is moved and retained. FIG. 7 depicts the clamp in an open position 52 illustrating pin 54 removed from opening 56. A corresponding opening is found on the opposite side of the toe connector and corresponding openings are located on or within the second toe connector 59.

Figure 8:
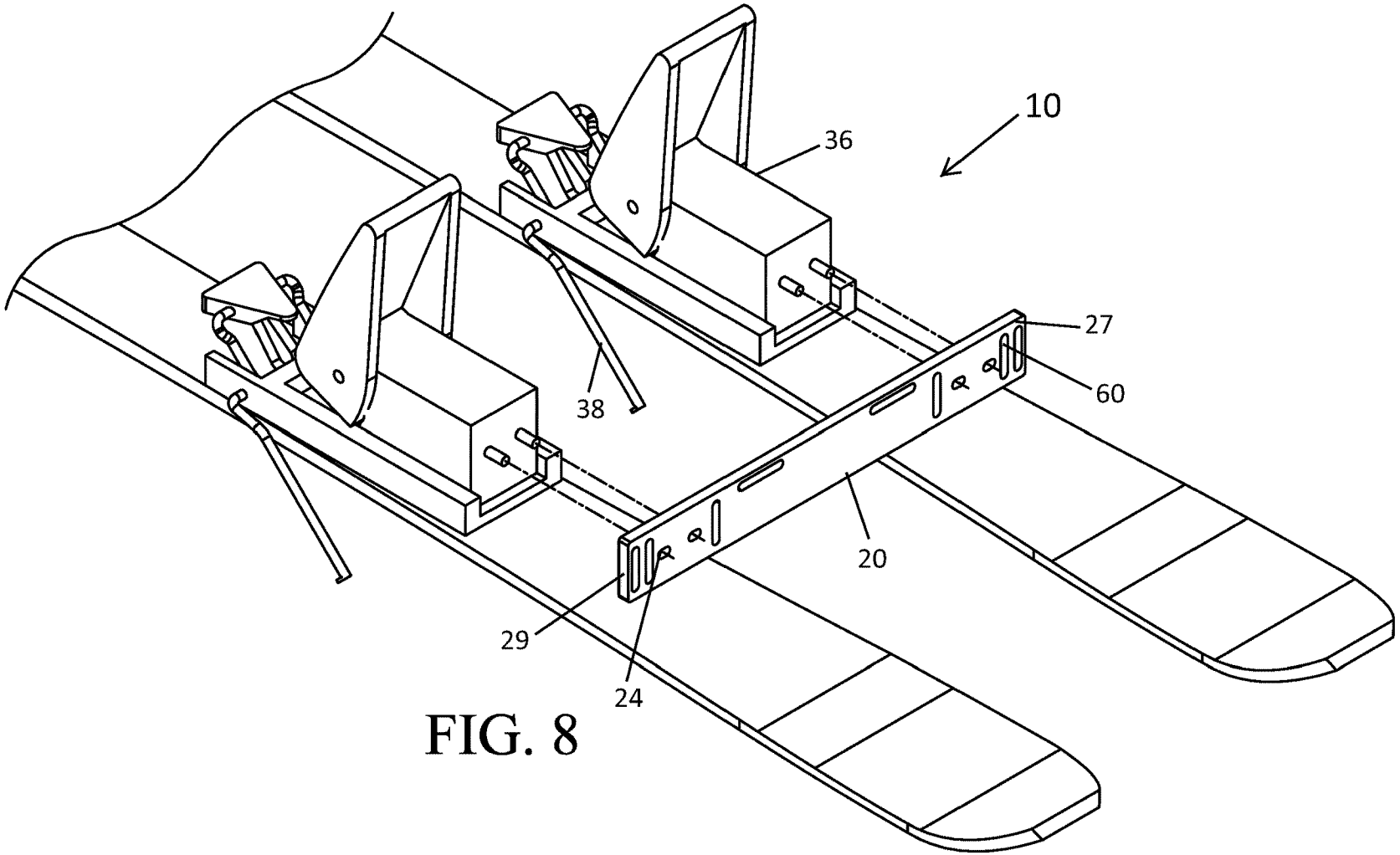
FIG. 8 is a perspective exploded view of an embodiment of a ski binding rescue device attachment mechanism to a rear binding.
Figure 10:
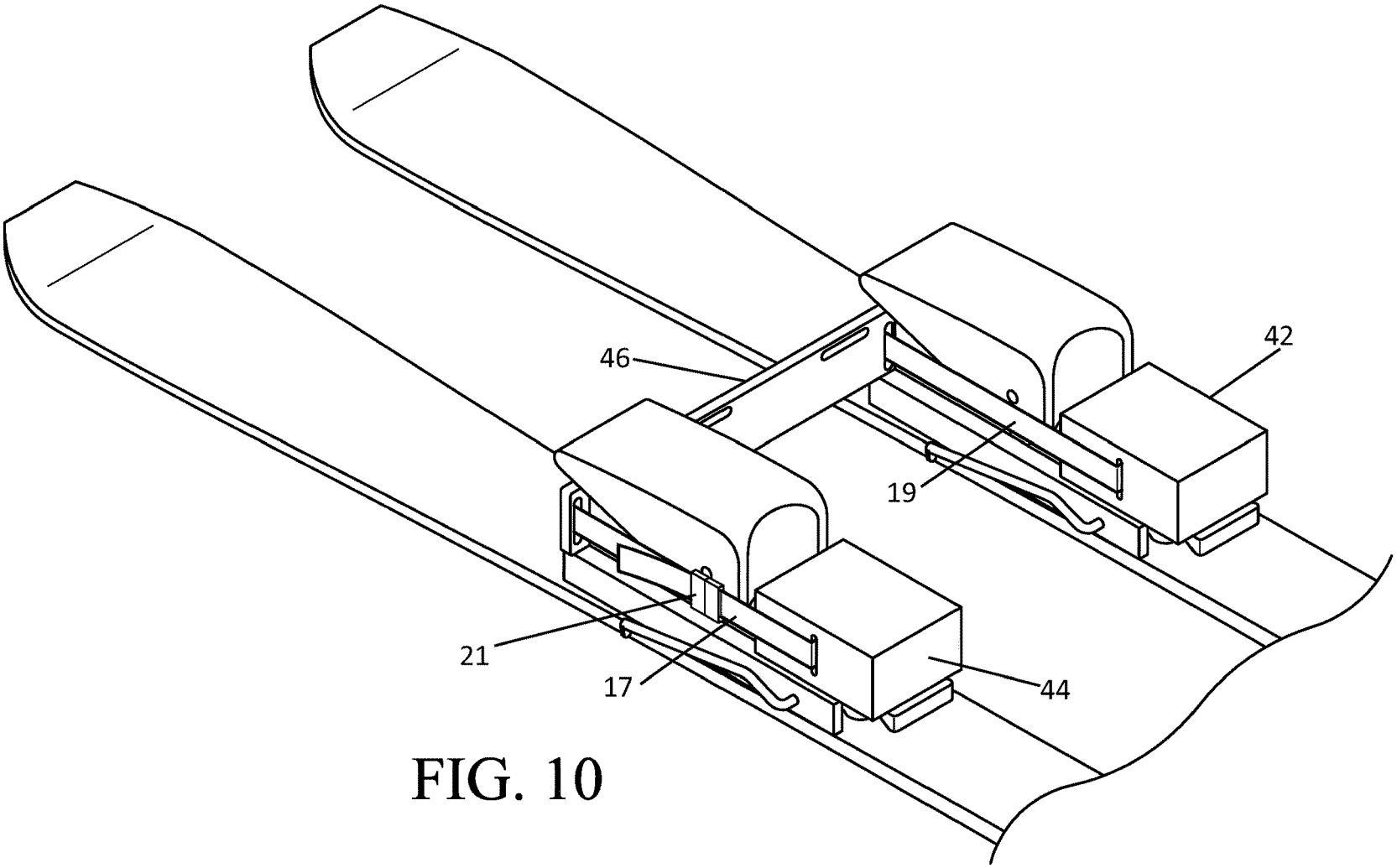
FIG. 10 is a perspective view of an embodiment of a ski binding rescue device attachment mechanism to a rear binding.

FIG. 8 is an exploded perspective view of an embodiment of the inventive concepts of the ski binding rescue device 10 depicting the mechanism of attachment of heel member 20 attached to pin-tech ski bindings, with the heel member 20 in the foreground showing the integrated heel mount recesses 24 engaging the pins. Restraining straps 26, 28 illustrated in FIG. 9 are tightened around the body of the heel bindings 36 to restrain the heel member 20 via restraining strap openings 60. Alternatively FIG. 10 illustrates individual straps 17, 19 circumvolving binding heel pieces in an alternative embodiment. FIG. 8 depicts the heel portions of the pin-tech ski bindings 36 rotated such that the pins are facing the tail of the skis. This position keeps the brake 38 in a disengaged position allowing the ski to slide along the snow with minimal resistance. The pins of the heel portions of the bindings 36 are engaged with the heel mount recesses 24 of the heel member 20 and the restraining straps 26, 28 are encompassing the bodies of the heel portions of the bindings 36. The first restraining strap 26 and second restraining strap 28 are connected via the buckle 30 forming a single restraining strap 31 which encompasses both heel pieces and thereby secures heel member 20 to the bindings 36. In FIG. 10 straps 17, 19 circumvolve individual ski bindings from each straps connection point with the heel connector 46. Optionally a simulator mechanism 42, 44 for simulating a user's heel can be utilized to engage the heel of the binding. The straps 17, 19 can utilize a tensioning member 21 to adjust the tension on the straps.

Optionally the ski binding rescue device depicting the toe member 12 and heel member 20 can include an attached securing material, for example, in the form of loops affixed to the ends of the toe member 12 and heel member 20. The securing material can be used to attach additional gear for ease of transport, or assist in securing the injured person to the ski binding rescue device through the use of additional straps or other devices.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

I claim:

1. A device for use with a pair of skis comprising a first ski and a second ski with mounted ski bindings, each ski binding having a toe clamp and a heel clamp, said device comprising:

a toe member comprising an elongated, rigid body being of sufficient length such that said toe member is configured to span a width between each of said pair of skis when said skis are placed adjacent to one other on the ground as is common during use, wherein said toe member comprises a first toe mount and a second toe mount, wherein said first toe mount and said second toe mount are configured to attach to the toe clamp of said first ski and the toe clamp of said second ski, each of said toe mounts attachable to said toe member such that said toe member with affixed toe mounts operates as a single unit;

a heel member comprising an elongated, rigid body with a first heel end and a second heel end and being of sufficient length such that said heel member is configured to span the width between said pair of skis when said skis are placed adjacent to each other on the ground as is common during use, wherein said heel member comprising a first heel mount and a second heel mount, wherein said first heel mount and said second heel mount are configured to attach to the heel clamp of said first ski and the heel clamp of said second ski, each of said heel mounts attachable to said heel member such that said heel member with affixed heel mounts operates as a single unit with each heel mount remaining capable of being engaged by one of said heel clamps, wherein said heel member comprises at least one strap attachable to said heel member at said first heel end and at said second heel end and capable of encompassing said heel clamps in their side-by-side position thereby affixing said heel member with integrated heel mounts to said heel clamps, wherein, upon securing said toe member with affixed toe mounts into said toe clamps, and securing said heel member with affixed heel mounts into said heel clamps, said pair of skis is coupled such that the pair of skis and connecting toe member and heel member function as a single unit, wherein said device is configured to attach to a pair of skis and said pair of skis are configured to form a sled when said device is attached to said ski.

2. The device of claim 1 wherein said toe member and said heel member are each expandable and retractable in length.

3. The device of claim 2 wherein said toe member and said heel member include a locking device capable of locking said toe member and said heel member at a desired length.

4. The device of claim 1, wherein said toe mounts comprise a first indentation and a second indentation, wherein said indentations are configured to receive opposing pins of a TECH style toe clamp binding.

5. The device of claim 1 wherein said toe mounts and said heel mounts are configured to engage with a pin-tech style Alpine Touring ski binding.

6. The device of claim 1 wherein said toe member and said heel member are affixed to one or more pieces of securing material configured for securing cargo.

7. The device of claim 1 wherein said heel member comprises at least two straps attachable to said heel members at said first heel end and said second heel end and capable of encompassing said heel clamps in a side-by-side position thereby affixing said heel member with attached and engaged heel mounts to said heel clamps.

8. A method of forming a sled utilizing a pair of skis, said pair of skis having a first ski and a second ski, wherein said first ski and said second ski comprise a ski binding comprising a toe clamp and a heel clamp, said method comprising the following steps:

the step of providing a binding toe connector having a first toe clamp connection member and a second toe clamp connection member, wherein said binding toe connector comprises a rigid length separating said first toe clamp connection member and said second toe clamp connection member;

the step of providing a binding heel connector having a first heel clamp connection member and a second heel clamp connection member, wherein said binding heel connector comprises a rigid length separating said first heel clamp connection member and said second heel clamp connection member, wherein said binding heel connector comprises at least one strap attachable to said binding heel connector at said first heel connection member and capable of encompassing both of said heel clamps in clamp connection member and said second heel clamp side-by-side position thereby affixing said binding heel connector a to said heel clamps;

the step of attaching said binding toe connector to said pair of skis, wherein said step comprises connecting said first toe clamp connection member to said first ski at said ski binding toe clamp and attaching said second toe clamp connection member to said second ski at said ski binding toe clamp;

the step of attaching said binding heel connector to said pair of skis, wherein said step comprises connecting said first heel clamp connection member to said first ski at said ski binding heel clamp and attaching said second heel clamp connection member to said second ski at said ski binding heel clamp such that said first ski and said second ski are in a generally parallel orientation and maintained in said orientation by said binding toe connector and said binding heel connector; and the step of attaching a cargo to a sled formed by the aforementioned steps.

9. The method of claim 8, wherein said toe clamp connection members and said heel clamp connection members are configured to engage with a pin-tech style Alpine Touring ski binding.

10. The method of claim 8, wherein said toe connector and said heel connector are each expandable and retractable in length.

11. The method of claim 8, wherein said toe connector and said heel connector comprise openings configured for the attachment of straps.

12. The method of claim 8, wherein said toe connector and said heel connector comprise at least one material selected from the group consisting of: aluminum, titanium, and high strength plastic.

13. The method of claim 8, wherein said toe clamp connection members comprise a first indentation and a second indentation, wherein said indentations are configured to receive opposing pins of a TECH style toe clamp binding.

* * * * *